US009227312B2

(12) United States Patent
Wang

(10) Patent No.: US 9,227,312 B2
(45) Date of Patent: Jan. 5, 2016

(54) LIGHT SINGLE-BUTTON MULTIFUNCTIONAL ELECTRIC HAMMER

(75) Inventor: Wenjiang Wang, Jinhua (CN)

(73) Assignee: ZHEJIANG HAIWANG ELECTRIC MACHINE CO., LTD., Jinhua, Zhejiang Province (CN)

( * ) Notice: Subject to any disclaimer, the term of this patent is extended or adjusted under 35 U.S.C. 154(b) by 806 days.

(21) Appl. No.: 13/502,400

(22) PCT Filed: Mar. 10, 2010

(86) PCT No.: PCT/CN2010/070975

§ 371 (c)(1),
(2), (4) Date: Apr. 17, 2012

(87) PCT Pub. No.: WO2011/088631

PCT Pub. Date: Jul. 28, 2011

(65) Prior Publication Data

US 2012/0205132 A1 Aug. 16, 2012

(30) Foreign Application Priority Data

Jan. 21, 2010 (CN) ..... 2010 1 0100705

(51) Int. Cl.

*B25D 11/08* (2006.01)
*B25D 16/00* (2006.01)
*B25D 11/06* (2006.01)

(52) U.S. Cl.

CPC ..... *B25D 16/006* (2013.01); *B25D 11/062* (2013.01); *B25D 2211/061* (2013.01); *B25D 2216/0015* (2013.01);

(Continued)

(58) Field of Classification Search

CPC ..... B25D 11/08; B25D 16/00; B25D 16/003; B25D 16/006; B25D 11/00; B25D 11/062; B25D 2211/006; B25D 2211/061; B25D 2216/0084; B25D 2216/0092; B25D 2250/371; B25D 2211/003; B25F 3/00

USPC ..... 173/48, 90, 40, 109, 122; 227/147

See application file for complete search history.

(56) References Cited

U.S. PATENT DOCUMENTS 3,430,709 A * 3/1969 Miller ..... 173/205
3,596,525 A * 8/1971 Niesz ..... 74/57

(Continued)

FOREIGN PATENT DOCUMENTS

CN 2920563 Y 7/2007
CN 101157214 A 4/2008

(Continued)

*Primary Examiner* — Gloria R Weeks
*Assistant Examiner* — Eduardo R Ferrero
(74) *Attorney, Agent, or Firm* — Jiwen Chen

(57) ABSTRACT

A light single button multi-function electric hammer comprises a body, a motor, a rotation set assembly, a cylinder assembly, a torque spring, a knob, a gearwheel and a transmission mechanism of torque clutch. The transmission mechanism comprises a pinion, a gear clutch, a middle shaft, a hammer crosspiece clutch, a swing rod bearing and a primary gear. The pinion is movably fitted with the middle shaft; the pinion meshes large end teeth of the gearwheel and matches with the inner teeth of the gear clutch. The gear clutch meshes small end teeth of the gearwheel and is fitted with the teeth shaft of the middle shaft. The gear clutch and the hammer crosspiece clutch are movably fitted with the teeth shaft of the middle shaft. The knob is connected with an operating mechanism linked to the large teeth end of the gearwheel, the gear clutch and the hammer crosspiece clutch.

2 Claims, 13 Drawing Sheets

(52) U.S. Cl.
CPC ..... *B25D 2216/0023* (2013.01); *B25D 2216/0038* (2013.01); *B25D 2216/0084* (2013.01); *B25D 2250/255* (2013.01)

(56) References Cited

U.S. PATENT DOCUMENTS

| | | | | | |
|---|---|---|---|---|---|
| 3,785,443 | A * | 1/1974 | Armbruster | 173/48 |
| 3,794,124 | A * | 2/1974 | Biersack | 173/104 |
| 3,808,904 | A * | 5/1974 | Gotsch et al. | 74/343 |
| 4,418,766 | A * | 12/1983 | Grossmann | 173/13 |
| 4,529,044 | A * | 7/1985 | Klueber et al. | 173/48 |
| 5,125,461 | A * | 6/1992 | Hoser | 173/48 |
| 5,277,259 | A * | 1/1994 | Schmid et al. | 173/13 |
| 5,511,912 | A * | 4/1996 | Ellerbrock | 408/20 |
| 5,992,257 | A * | 11/1999 | Nemetz et al. | 74/371 |
| 6,109,364 | A * | 8/2000 | Demuth et al. | 173/48 |
| 6,192,996 | B1 * | 2/2001 | Sakaguchi et al. | 173/48 |
| 6,213,222 | B1 * | 4/2001 | Banach | 173/1 |
| 6,223,833 | B1 * | 5/2001 | Thurler et al. | 173/48 |
| 6,460,627 | B1 * | 10/2002 | Below et al. | 173/48 |
| 6,918,450 | B2 * | 7/2005 | Lebisch et al. | 173/104 |
| 6,971,455 | B2 * | 12/2005 | Shibata et al. | 173/48 |
| 7,036,607 | B2 * | 5/2006 | Lebisch et al. | 173/109 |
| 7,410,009 | B2 * | 8/2008 | Hirayama et al. | 173/201 |
| 7,762,349 | B2 * | 7/2010 | Trautner et al. | 173/176 |
| 7,854,274 | B2 * | 12/2010 | Trautner et al. | 173/48 |
| 7,886,841 | B2 * | 2/2011 | Armstrong | 173/176 |
| 8,490,715 | B2 * | 7/2013 | Engelfried et al. | 173/109 |
| 2003/0079562 | A1 * | 5/2003 | Schaible et al. | 74/473.37 |
| 2004/0003931 | A1 * | 1/2004 | Mueller et al. | 173/90 |
| 2004/0020668 | A1 * | 2/2004 | Baumann et al. | 173/90 |
| 2004/0026099 | A1 * | 2/2004 | Stirm | 173/178 |
| 2004/0074653 | A1 * | 4/2004 | Hashimoto et al. | 173/109 |
| 2004/0216976 | A1 * | 11/2004 | Droste | 192/55.1 |
| 2004/0231866 | A1 * | 11/2004 | Droste | 173/48 |
| 2005/0224242 | A1 * | 10/2005 | Britz et al. | 173/15 |
| 2006/0032645 | A1 * | 2/2006 | Shimma et al. | 173/48 |
| 2006/0113097 | A1 * | 6/2006 | Simm et al. | 173/48 |
| 2007/0074883 | A1 * | 4/2007 | Strasser et al. | 173/104 |
| 2007/0193756 | A1 * | 8/2007 | Saur | 173/48 |
| 2007/0209815 | A1 * | 9/2007 | Iwakami et al. | 173/48 |
| 2008/0073092 | A1 * | 3/2008 | Yeoh et al. | 173/48 |
| 2008/0196915 | A1 * | 8/2008 | Stirm et al. | 173/210 |
| 2008/0223592 | A1 * | 9/2008 | Erhardt | 173/48 |
| 2008/0296036 | A1 * | 12/2008 | Simm et al. | 173/178 |
| 2009/0008111 | A1 * | 1/2009 | Liebert et al. | 173/18 |
| 2009/0126958 | A1 * | 5/2009 | Trautner et al. | 173/48 |
| 2009/0145617 | A1 * | 6/2009 | Duesselberg et al. | 173/48 |
| 2009/0145618 | A1 * | 6/2009 | Duesselberg et al. | 173/48 |
| 2009/0188688 | A1 * | 7/2009 | Gumpert et al. | 173/104 |
| 2009/0223692 | A1 * | 9/2009 | Yoshikane | 173/133 |
| 2009/0308626 | A1 * | 12/2009 | Saur | 173/48 |
| 2010/0025059 | A1 * | 2/2010 | Felger | 173/47 |
| 2010/0026107 | A1 * | 2/2010 | Hosokawa | 310/50 |
| 2010/0084151 | A1 * | 4/2010 | Kuhnle et al. | 173/47 |
| 2010/0096153 | A1 * | 4/2010 | Ullrich et al. | 173/47 |
| 2010/0200380 | A1 * | 8/2010 | Staas et al. | 200/293 |
| 2010/0307882 | A1 * | 12/2010 | Ullrich et al. | 192/20 |
| 2010/0319946 | A1 * | 12/2010 | Ullrich et al. | 173/122 |
| 2012/0099936 | A1 * | 4/2012 | Bean et al. | 408/124 |
| 2012/0234568 | A1 * | 9/2012 | Schnell et al. | 173/170 |
| 2013/0186663 | A1 * | 7/2013 | Zhou | 173/48 |
| 2013/0319709 | A1 * | 12/2013 | Hecht et al. | 173/109 |
| 2014/0054057 | A1 * | 2/2014 | Ludy et al. | 173/48 |

FOREIGN PATENT DOCUMENTS

| | | | | |
|---|---|---|---|---|
| EP | 1987925 | A1 * | 11/2008 | B25D 16/00 |
| EP | 2055440 | A1 * | 5/2009 | B25D 16/00 |
| WO | WO 2008009211 | A1 * | 1/2008 | B25D 11/06 |

* cited by examiner

LIGHT SINGLE-BUTTON MULTIFUNCTIONAL ELECTRIC HAMMER

This is a U.S. national stage application of PCT Application No. PCT/CN2010/070975 under 35 U.S.C. 371, filed Mar. 10, 2010 in Chinese, claiming the priority benefit of Chinese Application No. 201010100705.2, filed Jan. 21, 2010, which is hereby incorporated by reference.

FIELD OF THE INVENTION

The present invention relates to an electric tool, and more specially relates to a multifunctional electric hammer.

DESCRIPTION OF THE PRIOR ART

With the development of the industry of power tools, people have more and more demand for the functions of power tools than ever. The four functions of an electric hammer, comprising the four functions of single hammering, single drilling, hammer drilling and single hammer angle adjustment, are well received by many users. However, slow single drilling speed has always been a shortcoming of electric hammers. Although the functions of an electric hammer can be switched with one button, yet it is difficult to achieve these functions because of its complicated structure, high manufacturing cost and short service life. It is inconvenient for operators to use the single drilling function because of the slow rotational speed under the condition of unchanged gear ratio.

SUMMARY OF THE INVENTION

Accordingly, in order to overcome the above shortcomings of the complicated structure, high manufacturing cost and short service life existed in electric hammers occurring in the related art, a first object of the present invention is to provide a light single-button multifunctional electric hammer with a simple and reasonable structure, an easy and flexible function switch, low cost, safe and reliable performance.

The technology scheme of the present invention to solve relevant problems is as follows:

A light single-button multifunctional electric hammer comprises a hammer body, a motor, a rotary bush assembly, a cylinder assembly, a operating mechanism and knobs. The motor, rotary bush assembly, cylinder assembly and operating mechanism are installed in the hammer body. The knobs and paddle shifter assembly are interlocked. The light single-button multifunctional electric hammer also comprises a bull gear and a transmission mechanism. The bull gear comprises a heel (large) end teeth part and a toe (small) end teeth part. The heel end teeth part take the form of a heel end gear with multiple teeth. The toe end teeth part take the form of a toe end gear with few teeth than the multiple teeth of the heel end gear. The torque clutch transmission gear comprises a pinion, a gear clutch, a middle shaft, a hammering gear clutch, a swing rod bearing and a primary gear. The pinion and middle shaft movably fit. The pinion is engaged with the heel end teeth part of the bull gear and is engaged with an inner gear of the gear clutch. The gear clutch is configured to fit with the toe end teeth part of the bull gear and middle shaft. The gear clutch and hammering gear clutch are fitted with the middle shaft. The swing rod bearing is movably fitted with the middle shaft and is connected to the cylinder assembly through the swing rod. The hammering gear clutch and the swing rod bearing are provided with mating concave convex grooves, and the primary gear and the middle shaft fit closely. The knob is connected to an operating mechanism. The operating mechanism is adapted to fit with heel end teeth part of bull gear, the gear clutch and the hammering gear clutch.

The operating mechanism comprises a stop plate spring, a stop plate, a drilling gear paddle shifter, a paddle shifter support, inner knobs, a hammering gear paddle shifter, a tension spring, a paddle shifter spring and a guide pillar. The stop plate spring, stop plate, drilling gear paddle shifter, paddle shifter support, hammering gear paddle shifter and tension spring are sequentially installed on the guide pillar in order. The stop plate is provided with stop teeth to match the heel end teeth part of bull gear and is positioned on one side of inner knob. The other side of the drilling gear paddle shifter is snapped on the paddle shifter support. A tension spring is provided between the drilling gear paddle shifter and paddle shifter support. The other side of the paddle shifter support is snapped on the hammering gear paddle shifter. A paddle shifter spring is provided between the paddle shifter support and hammering gear paddle shifter. The paddle shifters of drilling gear paddle shifter are provided correspondingly on each side of the gear clutch to clamp gear clutch. The hammering gear fork of the hammering gear paddle shifter is provided correspondingly in the groove of hammering gear clutch.

To make the accurate function switch, the knob is provided on one side with an elliptical paddle shifter diverged from the knob center. The elliptical paddle shifter is provided between the paddle shifter support and hammering gear clutch, and also provided with a quadrant lug. A semicircular lug is provided on the other side with its outer edge supporting the positioning plate of stop plate.

To prevent overload running, needle radial positioning is adopted between the torque clutch and the rotary bush assembly. The bull gear is movably fitted with the rotary bush assembly. The torque clutch and bull gear are provided with concave convex grooves integrally.

After adopting the above structure, the knob coordinates with stop plate, paddle shifter support and hammering gear paddle shifter in various conditions through elliptical paddle shifter, quadrant lug and semicircular lug. The paddle shifter support drives the drilling gear paddle shifter to enable the gear clutch to be disengaged with the pinion and engaged with toe end teeth part of bull gear. The hammering gear paddle shifter drives the hammering gear clutch to disengage with the swing rod bearing. Thus, the electric hammer can realize smooth shift among five functions: single drilling 1, single drilling 2, single hammering, hammer drilling and single hammer angle adjustment.

Through torque spring, the bull gear is fitted with convex-concave grooves of the torque clutch and is disengaged when overloading in the function of hammering and drilling, single drilling 1 and single drilling 2. It is characterized by simple structure, flexible and convenient switch, low cost, safe and reliable performance.

The benefits of the present invention are characterized by simple and reasonable structure, flexible and convenient switch, low cost, safe and reliable performance.

DETAILED DESCRIPTION OF THE PREFERRED EMBODIMENTS

Reference will now be made in greater detail to exemplary embodiments of the invention with reference to the accompanying drawings.

Figure 12:
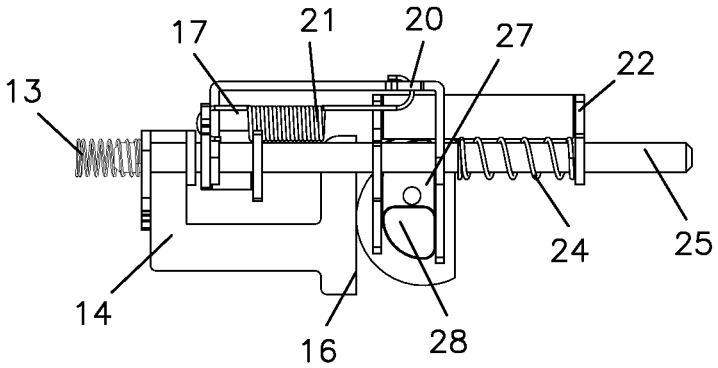
FIG. 12 is a schematic drawing showing the co-operation between the knobs and operating mechanism of the single hammer angle adjustment of the present invention.
Figure 13:
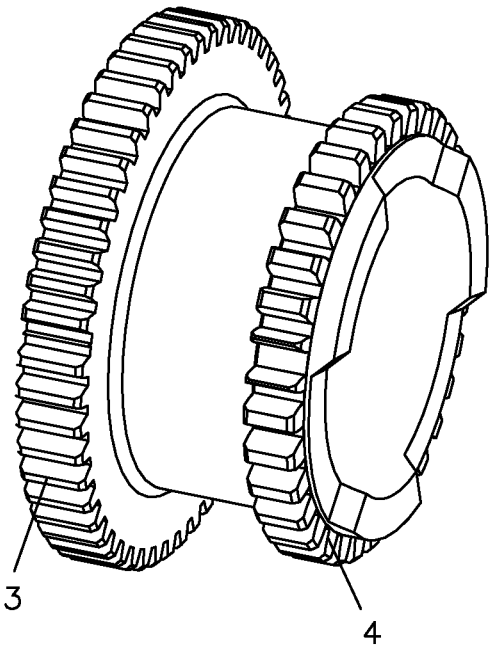
FIG. 13 is a schematic drawing showing the structure of the bull gear of the present invention.
Figure 14:
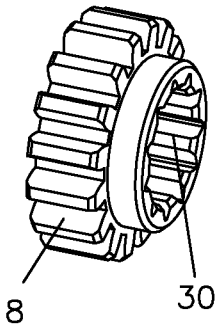
FIG. 14 is a schematic drawing showing the structure of the gear clutch of the present invention.
Figure 15:
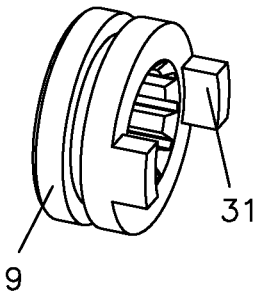
FIG. 15 is a schematic drawing showing the structure of the hammering gear clutch of the present invention.
Figure 16:
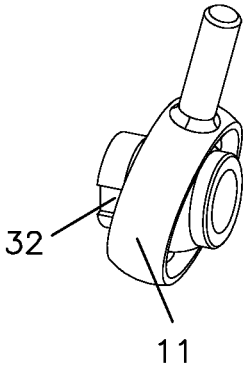
FIG. 16 is a schematic drawing showing the structure of the swing rod bearing of the present invention.
Figure 17:
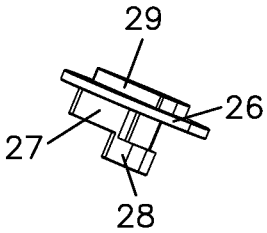
FIG. 17 is a schematic drawing showing the structure of the swing rod bearing knob of the present invention.

With reference to FIG. 1 to FIG. 17, a light single-button multifunctional electric hammer comprises a hammer body (not shown), a motor (not shown), a rotary bush assembly (1), a cylinder assembly (6), a torque spring (2), a bull gear (see FIG. 13, the bull gear consists of two parts: one part is the heel end teeth part with multiple teeth, which is named in abbreviation as the heel end teeth part (3); the other part is the toe end teeth part with fewer teeth than the heel end teeth part, which is named in abbreviation as the toe end teeth part (4)), a torque spring (2), a transmission mechanism and a knob (26). The transmission mechanism comprises a pinion (7), a gear clutch (8), a middle shaft (10), a hammering gear clutch (9), a swing rod bearing (11) and a primary gear (12). The pinion (7) is movably fitted with middle shaft (10), is adapted to engage with heel end teeth part (3) of bull gear and is fitted with inner gear of the gear clutch (8). The gear clutch (8) is adapted to engage with toe end teeth part (4) of the bull gear. The gear clutch (8) and hammering gear clutch (9) are fitted with the gear shaft of middle shaft (10). The swing rod bearing (11) is movably fitted with middle shaft (10) and is connected to cylinder assembly (6) through the swing rod. The hammering gear clutch (9) and swing rod bearing (11) are provided with mating concave convex groove. The primary gear (12) is fitted with the middle shaft (10). The knob (26) is connected to operating mechanism. The operating mechanism is interlocked with heel end teeth part (3) of bull gear, gear clutch (8) and hammering gear clutch (9).

The operating mechanism comprises a stop plate spring (13), a stop plate (14), a drilling gear paddle shifter (17), a paddle shifter support (20), a hammering gear fork (23), a tension spring (21), a paddle shifter spring (24) and a guide pillar (25). The stop plate spring (13), stop plate (14), drilling gear paddle shifter (17), paddle shifter support (20), hammering gear fork (23), tension spring (21) and paddle shifter spring (24) are installed on the guide pillar (25) in order. The stop plate (14) is provided with a stop tooth to match the heel end teeth part (3) of bull gear and is positioned at one side of the knob (26). The other side of the drilling gear paddle shifter (17) is connected to the paddle shifter support (20). A tension spring (21) is provided between the drilling gear paddle shifter (17) and the paddle shifter support (20). The other side of the paddle shifter support (20) is snapped on the hammering gear paddle shifter (22). The paddle shifter spring (24) is provided between the paddle shifter support (20) and hammering gear paddle shifter (22). The paddle shifters of the drilling gear paddle shifter (17) are correspondingly provided on the each side of the gear clutch (8) to clamp the gear clutch (8). The hammering gear fork (23) of the hammering gear paddle shifter (22) is correspondingly provided in the slot of the hammering gear clutch (9).

The knob (26) is provided with an elliptical paddle shifter (27) diverged from center of the knob on one side. The elliptical paddle shifter (27) is provided between the paddle shifter support (20) and the hammering gear clutch (9), and The elliptical paddle shifter (27) is also provided with a quadrant lug (28) and a semicircular lug (29) on the other side. The outer edge of the semicircular lug (29) supports the positioning plate of the stop plate (14).

Needle radial positioning is adopted between the torque clutch and the rotary bush assembly. The bull gear is movably fitted with the rotary bush assembly. The torque clutch and bull gear are provided with mating concave convex grooves integrally. If torque clutch skids from bull gear, failing to transfer the rotating force to rotary bush assembly, the drill will stop for overload protection. After the load is lightened, the electrical hammer will restore normal work.

Reference will now be made in greater detail to exemplary embodiments of five functions of the present invention with reference to the accompanying drawings.

Figure 1:
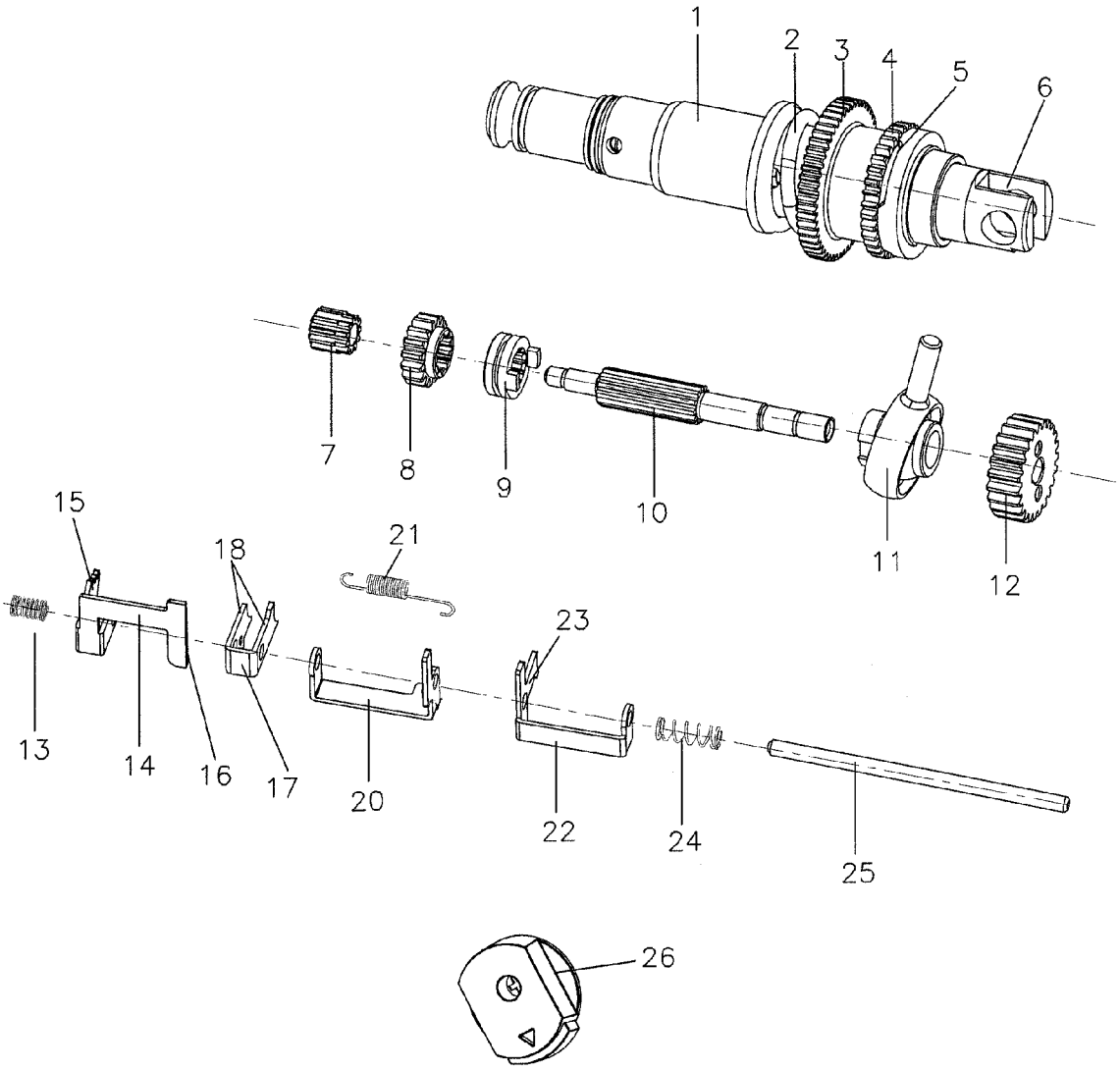
FIG. 1 is a schematic drawing showing the structure of the present invention.
Figure 2:
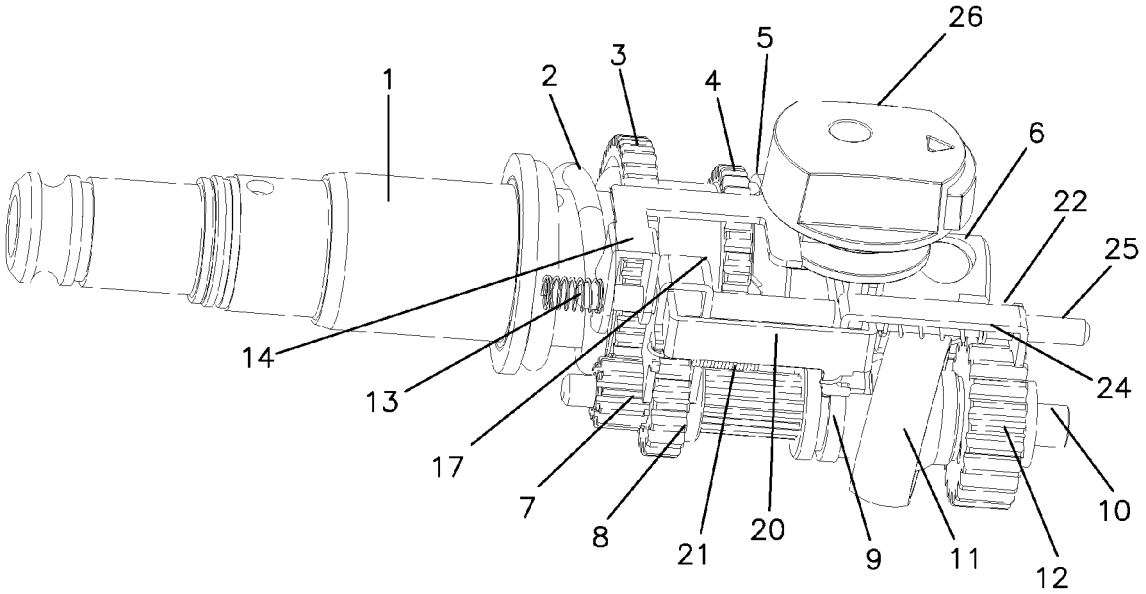
FIG. 2 is a schematic drawing of hammering and drilling of the present invention.
Figure 3:
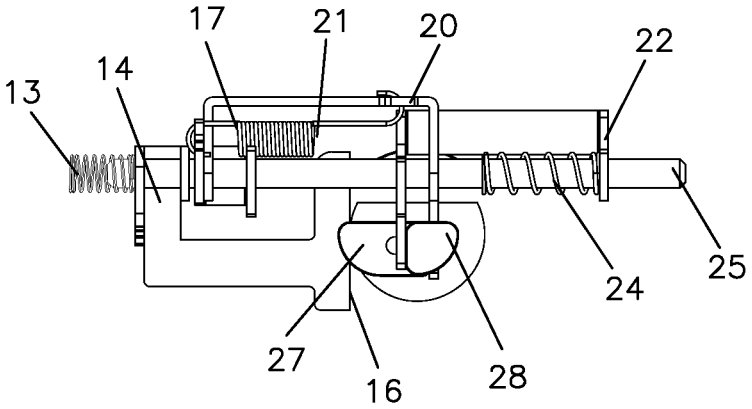
FIG. 3 is a schematic drawing showing the co-operation between knobs and operating mechanism in hammering and drilling of the present invention.
Figure 4:
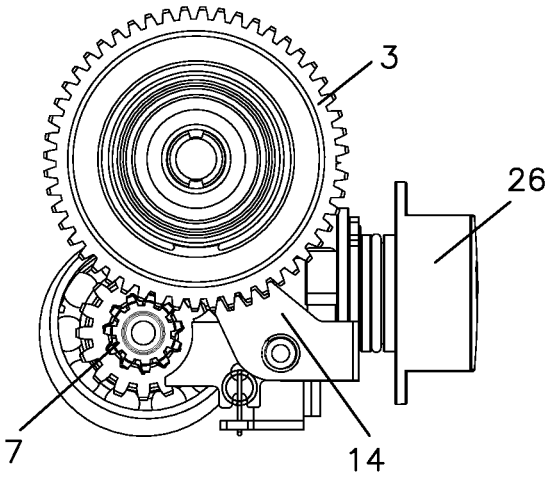
FIG. 4 is a schematic drawing showing the co-operation between bull gear and pinion and the blade of gear of the present invention.

The structure of the hammer drilling function of the present invention is shown in the FIG. 2 and/or FIG. 3. The elliptical paddle shifter (27) and the quadrant lug (28) are clamped between paddle shifter support (19, see FIG. 1) and hammering gear paddle shifter (22). An external dome of the semicircular lug (29, see FIG. 17) supports the positioning plate (16) of the stop plate (14). A tooth blade (15) of the stop plate (14) is disengaged from the heel end teeth part (3) of the bull gear while the pinion (7) is engaged with the heel end teeth part (3) of bull gear. Actuated by the drilling gear fork (18, see FIG. 1) of the drilling gear paddle shifter (17), one end of the gear clutch (8) is engaged with the teeth of the middle shaft (10) and the other end engages with the pinion (7). Actuated by the hammering gear fork (23) of the hammering gear paddle shifter (22), the internal tooth of the hammering gear clutch (9) is engaged with the teeth of the middle shaft (10). The hammering gear clutch (9) is connected to the swing rod bearing (11) through mating convex-concave grooves (31,32, see Gifs. 15-16). During operation, the motor output shaft drives the primary gear (12) and consequently the primary gear (12) drives the middle shaft (10). The middle shaft (10) drives the rotary bush assembly (1) through the gear clutch (8), pinion (7), heel end teeth part (3) of bull gear and torque clutch (5) to transfer rotating force. The middle shaft (10) drives the swing rod bearing (11) through the hammering gear clutch (9). The swing rod bearing (11) drives the reciprocation of cylinder assembly (6) to impel an pneumatic striking part of the cylinder assembly (6) to strike a ram, transferring impact energy to realize hammer drilling function of the electrical hammer.

Figure 5:
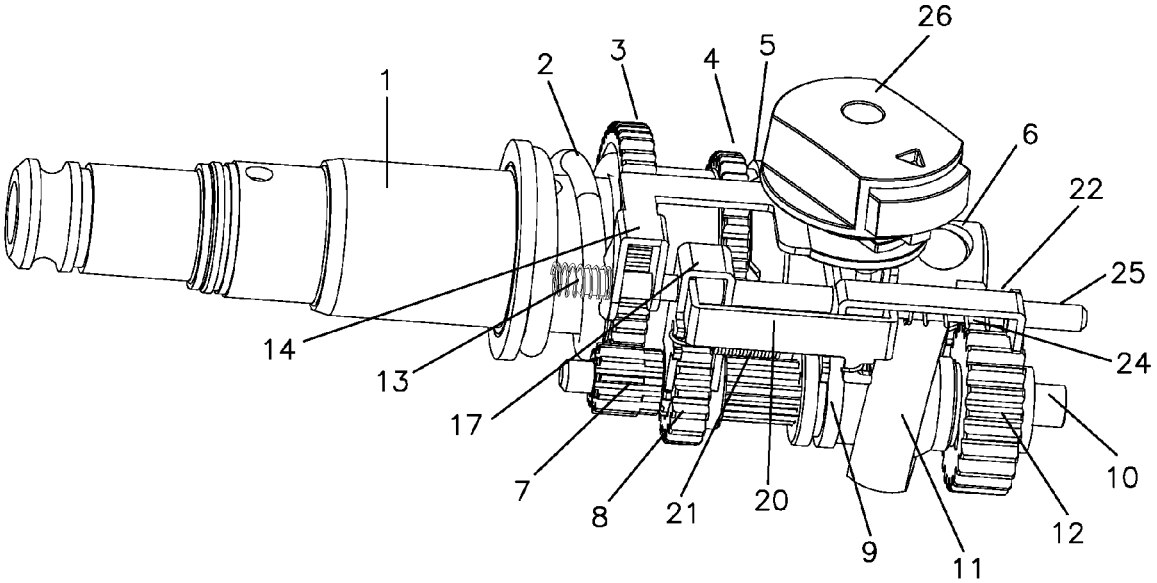
FIG. 5 is a schematic drawing showing the structure of the single drilling 1 of the present invention.
Figure 6:
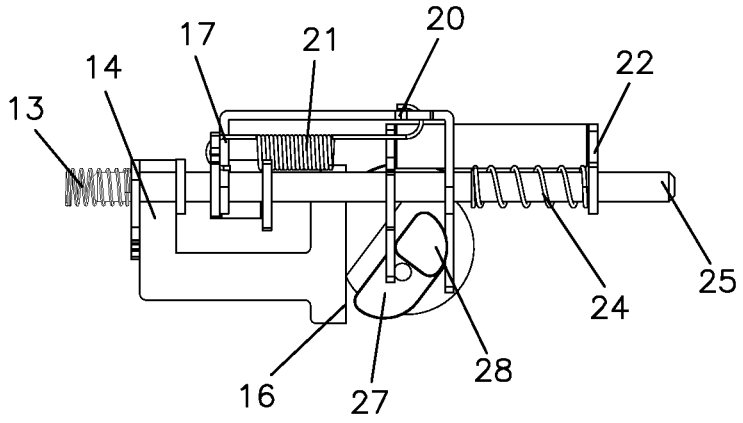
FIG. 6 is a schematic drawing showing the co-operation between knobs and operating mechanism of drilling 1 of the present invention.

The structure of single hammer angle adjustment function of the electrical hammer of the present invention is shown in FIG. 5 and FIG. 6. When the knob (26) is switched to the single hammer angle adjustment mode in downtime as shown in the FIG. 6, the positioning plate (16) of the stop plate (14) will contact with the semicircular surface of the semicircular lug (29, see FIG. 17) on the knob (26). The rotation radius of knob (26) and the position of the stop plate (14) remain unchanged. The teeth (15) of the stop plate (14) remain separated with heel end teeth part (3) of bull gear. The rotation radius of the contact surface between the quadrant lug (28, see FIG. 17) and the hammering gear paddle shifter (22) remains unchanged, and the hammering gear paddle shifter (22) also remains unmoved. The hammering gear clutch (9) is connected to the swing rod bearing (11) through the mating convex-concave grooves (31, 32, see FIGS. 15-16). When change occurs to the rotation radius of the elliptical paddle shifter (27) and the paddle shifter support (20), the elliptical paddle shifter (27) deviating from the rotation center drives the paddle shifter support (20, see FIG. 1) to move to the right, and consequently the paddle shifter support (20) drives the drilling gear paddle shifter (17) and the gear clutch (8) to move to the right and is disengaged from the pinion (7). Now the pinion (7), heel end teeth part (3) of bull gear, torque clutch (5) and rotary bush assembly (1) are in neutral transmission mode, the rotary bush assembly (1) can easily adjust the angle of drills to realize function of single hammer angle adjustment of the electrical hammer.

Figure 7:
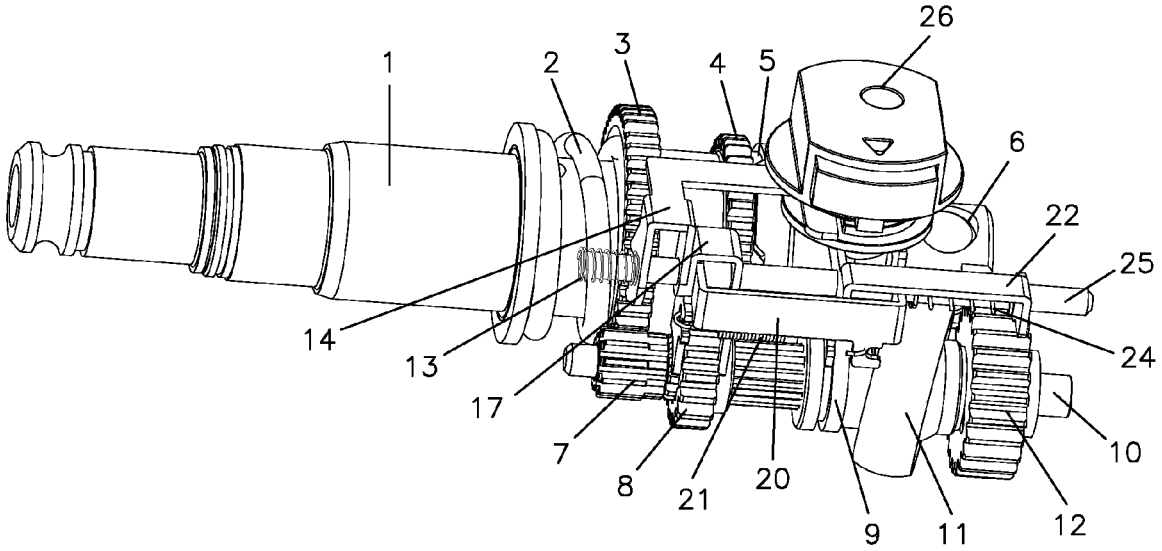
FIG. 7 is a schematic drawing showing the structure of the single drilling 2 of the present invention.
Figure 8:
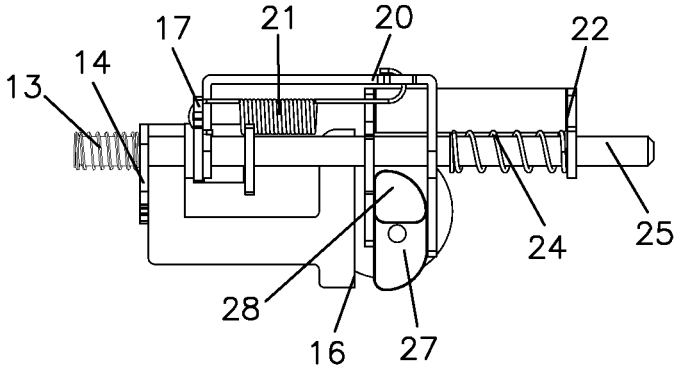
FIG. 8 is a schematic drawing showing the co-operation between knobs and operating mechanism of drilling 2 of the present invention.

The structure of single hammer function of the present invention is shown in the FIG. 7 and FIG. 8. When the knob (26) is switched to the single hammer mode as shown in the FIG. 8, the positioning plate (16) of the stop plate (14) will contact the semicircular surface of the semicircular lug (29, see FIG. 17) on the knob (26). The rotation radius of the knob (26) is at the minimum. The tooth blade (15) of the stop plate (14) is engaged with the heel end teeth part (3) of bull gear. The rotation radius of the contact surface between the quadrant lug (28) and the hammering gear paddle shifter (22) remains unchanged, and the hammering gear paddle shifter (22) also remains unmoved. The hammering gear clutch (9) is connected to the swing rod bearing (11) through mating convex-concave grooves (31, 32, see FIGS. 15-16). When change occurs to the elliptical paddle shifter (27) and rotation radius of paddle shifter support (19), the elliptical paddle shifter (27) deviating from the rotation center drives the paddle shifter support (19) to move to the right, and consequently the paddle shifter support (19) drives the drilling gear paddle shifter (17) and the gear clutch (8) to move to the right and is disengaged from the pinion (7). Now the pinion (7), heel end teeth part (3) of bull gear, torque clutch (5) and rotary bush assembly (1) are in neutral transmission. During operation, motor output shaft drives the primary gear (12) and consequently the primary gear (12) drives the middle shaft (10). Since the gear clutch (8) is separated completely from the pinion (7), the pinion (7) does not transfer rotating force, and heel end teeth part (3) of bull gear, torque clutch (5) and rotary bush assembly (1) do not rotate and cannot realize the function of drilling. The middle shaft (10) drives the swing rod bearing (11) through the hammering gear clutch (9). The swing rod bearing (11) drives the reciprocation of cylinder assembly (6) to impel an pneumatic striking part of the cylinder assembly (6) to strike a ram, transferring impact energy to realize the function of single hammering function of the electrical hammer. The tooth of the stop plate is engaged with the heel end teeth part of bull gear to lock the rotary bush assembly and to prevent the rotary bush assembly from rotating, thus ensuring the angles of drills unchanged at hammering.

Figure 9:
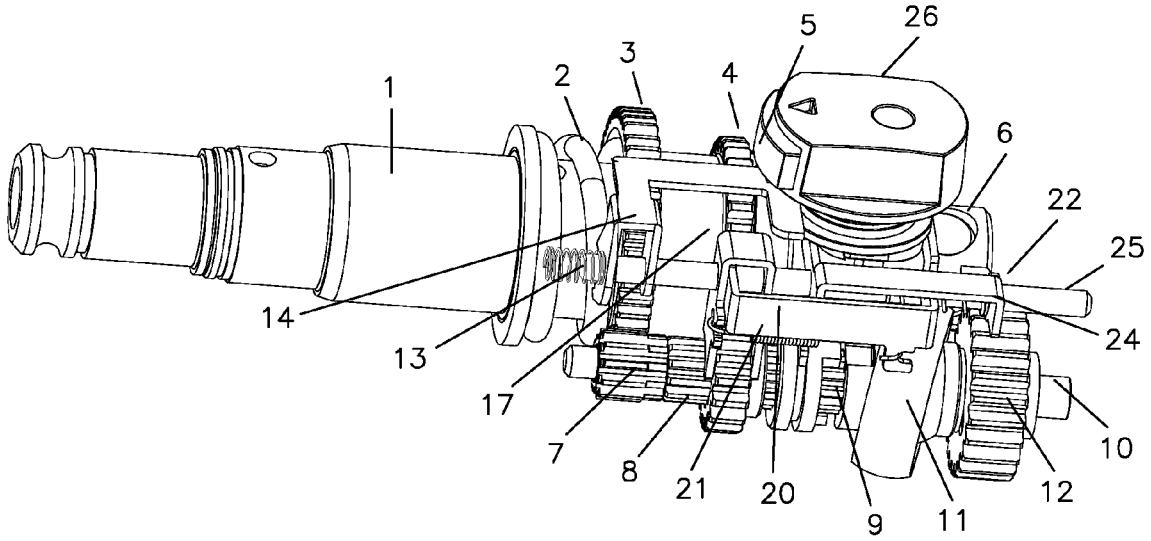
FIG. 9 is a schematic drawing showing the structure of the single hammering of the present invention.
Figure 10:
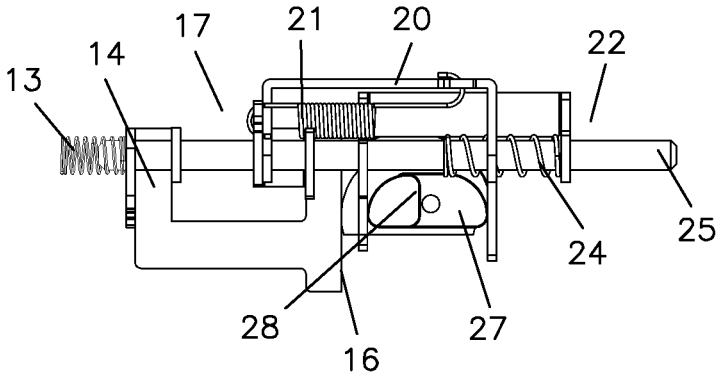
FIG. 10 is a schematic drawing showing the co-operation between knobs and operating mechanism of the single hammering of the present invention.

FIG. 9 shows the state when the knob is switched to the single drill function 2, and its structure is shown in FIG. 10. The positioning plate (16) of the stop plate (14) contacts with the semicircular surface of the semicircular lug (29, see FIG. 17) on the knob (26). The rotation radius of knob (26) is at the maximum. The position of the stop plate (14) is the same as that for the hammer drilling. The tooth blade (15) of the stop plate (14) is separated from the heel end teeth part (3) of bull gear. The pinion (7) is separated from the gear clutch (8) and the heel end teeth part (3) of bull gear. When change occurs to the contact surface of paddle shifter support (20) and the rotation radius of the elliptical paddle shifter (27) of the knob (26), the rotation radius of the knob (26) is at the maximum. The elliptical paddle shifter (27) deviating from the rotation center drives the paddle shifter support (20) to move to the right, and consequently the paddle shifter support (20) drives the gear clutch (8) and drilling gear paddle shifter (17) to move to the right. Tensioned by the tension spring (21) between the paddle shifter support (20) and the drilling gear paddle shifter (17), the outer tooth of gear clutch (8) is engaged with toe end teeth part (4) of the bull gear. The gear clutch (8) is disengaged from the pinion (7). When change occurs to the rotation radius of contact surface between quadrant lug (28) and hammering gear paddle shifter, the hammering gear paddle shifter (22) moves to the left. The hammering gear fork (23, see FIG. 1) drives the hammering gear clutch (9) to separate from mating with the convex-concave grooves (31, 32, see FIGS. 15-16) of the swing rod bearing. During operation, the motor output shaft drives the primary gear (12) and consequently the primary gear (12) drives the middle shaft (10). The middle shaft (10) drives the rotary bush assembly (1) through the gear clutch (8), toe end teeth part (4) of bull gear and the torque clutch (5) to transfer rotating force. Since the hammering gear clutch (9) is separated completely from the swing rod bearing (11), the swing rod bearing (11) does not drive the reciprocation of the cylinder assembly (6). The pneumatic striking part does not perform the function of hammering but realize the function of single drill 2.

Figure 11:
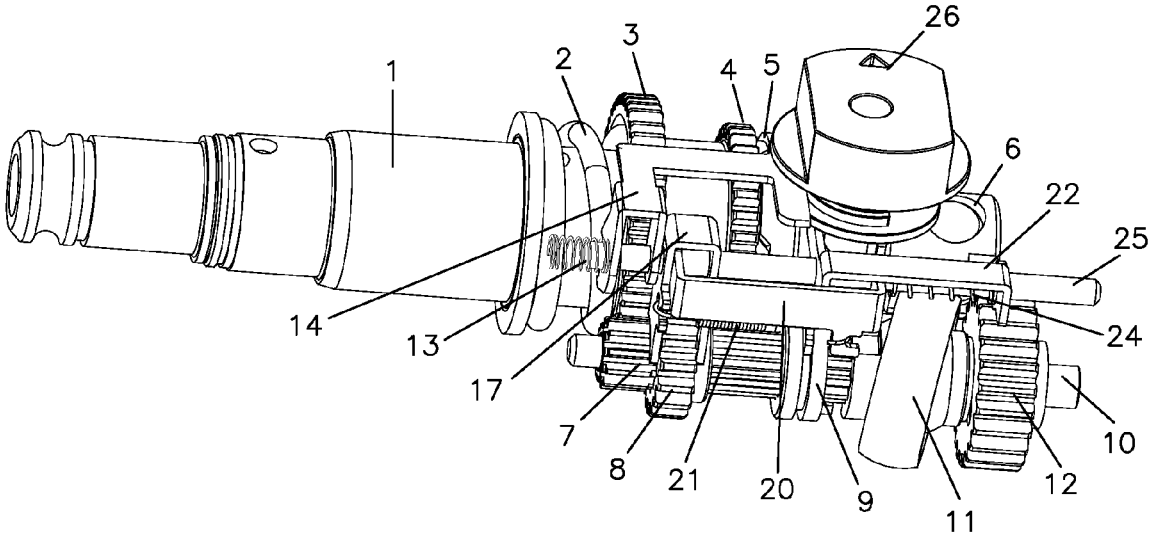
FIG. 11 is a schematic drawing showing the structure of the single hammer angle adjustment of the present invention.

FIG. 11 shows the state when the knob is switched to single drill 1, and its structure is shown in FIG. 12. The positioning plate (16) of the stop plate (14) contacts with a semicircular surface of the semicircular lug (29, see FIG. 17) on the knob (26). The rotation radius of the knob (26) is at the maximum. The position of the stop plate (14) is the same as that for hammer drilling. The tooth blade (15) of the stop plate (14) is separated from the heel end teeth part (3) of bull gear. Actuated by the drilling gear fork (18) of the drilling gear paddle shifter (17), one end of the gear clutch (8) is engaged with the teeth of the middle shaft (10) and the other end is engaged with the pinion (7). The pinion (7) is separated from toe end teeth part (4) of bull gear. When change occurs to the rotation radius of contact surface between the elliptical paddle shifter (27) of the knob (26) and the paddle shifter support (20). The rotation radius of the knob (26) is reduced. The position of the paddle shifter support (20) is the same as that for hammer drilling. Tensioned by the tension spring (21) between the paddle shifter support (20) and the drilling gear paddle shifter (17), the pinion (7) is engaged with the heel teeth part of bull gear. The rotation radius of the contact surface between the quadrant lug (28) and the hammering gear paddle shifter (22) remain unchanged. The position of the hammering gear paddle shifter (22) is the same as that for single drilling 2. The hammering gear fork (23) of the hammering gear paddle shifter (22) drives the hammering gear clutch (9) to disengage from mating with the convex-concave grooves (31, 32, see FIGS. 15-16). During operation, the motor output shaft drives the primary gear (12) and consequently the primary gear (12) drives the middle shaft (10). The middle shaft (10) drives the rotary bush assembly (1) through the gear clutch (8), pinion (7), heel end teeth part (3) of bull gear and torque clutch (5) to transfer rotating force. Since the hammering gear clutch (9) is separated from the swing rod bearing (11), the swing rod bearing (11) does not drive the reciprocation of the cylinder assembly (6). The pneumatic striking part of the cylinder assembly (6) does not perform the function of hammering but realize the function of a single drill 1.

The invention claimed is:

1. A light single-button multifunctional electric hammer, comprising a hammer body, a motor, a rotary bush assembly, a cylinder assembly, an operating mechanism and a knob; wherein the motor, rotary bush assembly, cylinder assembly and the operating mechanism are installed in the hammer body; the knob and a paddle shifter assembly are interlocked; the light single-button multifunctional electric hammer also comprises a bull gear and a transmission mechanism, the bull gear comprises a heel end teeth part and a toe end teeth part; the heel end teeth part has multiple teeth, the toe end teeth part has fewer teeth than the heel end teeth part, the transmission mechanism comprises a pinion, a gear clutch, a middle shaft, a hammering gear clutch, a swing rod bearing and a primary gear, the pinion and the middle shaft fit closely; the pinion is adapted to engage with the heel end teeth part of the bull gear and is engaged with an inner gear of the gear clutch; the gear clutch is adapted to fit with the toe end teeth part of the bull gear and is fitted with the middle shaft; the gear clutch and the hammering gear clutch are fitted with the middle shaft; the swing rod bearing is dynamically fitted with the middle shaft and is connected to the cylinder assembly through the swing rod; the hammering gear clutch and the swing rod bearing are provided with mating concave convex grooves, and the primary gear and the middle shaft fit closely; the knob is connected to the operating mechanism; the operating mechanism is adapted to fit with heel end teeth part of the bull gear, gear clutch and hammering gear clutch; wherein the operating mechanism comprises a stop plate spring, a stop plate, a drilling gear paddle shifter, a paddle shifter support, an inner knob, a hammering gear paddle shifter, a tension spring, a paddle shifter spring and a guide pillar; the stop plate spring, the stop plate, a first side of the drilling gear paddle shifter, a first side of the paddle shifter support, the hammering gear paddle shifter and the tension spring are serially installed on the guide pillar; the stop plate is provided with stop teeth to match the heel end teeth part of the bull gear and is positioned on one side of the inner knob; the other side of the drilling gear paddle shifter is snapped on the paddle shifter support; the tension spring is provided between the drilling gear paddle shifter and the paddle shifter support; the other side of the paddle shifter support is snapped on the hammering gear paddle shifter; a paddle shifter spring is provided between the paddle shifter support and the hammering gear paddle shifter; the paddle shifters of the drilling gear paddle shifter are provided correspondingly on each side of the gear clutch to clamp the gear clutch; a hammering gear fork of the hammering gear paddle shifter is provided correspondingly in the grooves of the hammering gear clutch.

2. The light single-button multifunctional electric hammer as set forth in claim 1, wherein the knob is provided on one side with an elliptical paddle shifter diverged from a center of the knob; the elliptical paddle shifter is provided between the paddle shifter support and the hammering gear clutch, and also provided with a quadrant lug; a semicircular lug is provided on the other side with its outer edge supporting a positioning plate of the stop plate.

* * * * *